US005994049A

United States Patent [19]

Tan et al.

[11] Patent Number: 5,994,049

[45] Date of Patent: Nov. 30, 1999

[54] WATER-SOLUBLE NON-INTERACTIVE POLYMERS AND SURFACTANT MICELLES FOR DESALTING AND CONCENTRATING SILVER HALIDE PHOTOGRAPHIC EMULSIONS

[75] Inventors: Julia S. Tan; Ramesh Jagannathan, both of Rochester, N.Y.

[73] Assignee: Eastman Kodak Company, Rochester, N.Y.

[21] Appl. No.: 08/921,944

[22] Filed: Aug. 28, 1997

[51] Int. Cl.[6] ..... G03C 1/015; G03C 1/04; G03C 1/047

[52] U.S. Cl. ..... 430/569; 430/634; 430/635; 430/637; 430/641

[58] Field of Search ..... 430/634, 635, 430/637, 641, 569

[56] References Cited

U.S. PATENT DOCUMENTS

| | | | |
|---|---|---|---|
| 2,527,260 | 10/1950 | Hart et al. | 430/642 |
| 2,565,418 | 8/1951 | Yackel | 430/569 |
| 2,614,928 | 10/1952 | Yutzy et al. | 430/569 |
| 2,614,929 | 10/1952 | Yutzy et al. | 430/569 |
| 2,614,931 | 10/1952 | Lowe et al. | 430/640 |
| 2,618,556 | 11/1952 | Hewitson et al. | 430/569 |
| 3,137,576 | 6/1964 | Himmelmann et al. | 430/569 |
| 3,168,403 | 2/1965 | Himmelmann et al. | 430/629 |
| 3,241,969 | 3/1966 | Hart et al. | 430/628 |
| 3,359,110 | 12/1967 | Frame | 430/628 |
| 3,396,027 | 8/1968 | McFall et al. | 430/642 |
| 3,455,694 | 7/1969 | Anderau et al. | 430/569 |
| 3,679,425 | 7/1972 | Hollister et al. | 430/627 |
| 3,867,154 | 2/1975 | Lukeian | 430/642 |
| 3,884,701 | 5/1975 | De Pauw et al. | 430/628 |
| 4,087,282 | 5/1978 | Mitsui et al. | 430/627 |
| 4,990,439 | 2/1991 | Goan et al. | 430/569 |
| 5,411,849 | 5/1995 | Hasegawa | 430/567 |
| 5,476,760 | 12/1995 | Asai et al. | 428/66.6 |
| 5,486,451 | 1/1996 | Vacca et al. | 430/569 |
| 5,523,201 | 6/1996 | Nimura et al. | 430/569 |
| 5,627,019 | 5/1997 | Vandenabeele et al. | 430/569 |

FOREIGN PATENT DOCUMENTS

| | | | |
|---|---|---|---|
| 0319920 | 12/1988 | European Pat. Off. | G03C 1/04 |
| 0517961A1 | 6/1991 | European Pat. Off. | G03C 1/04 |
| 62/32445 | 2/1987 | Japan | G03C 1/06 |
| 945334 | 12/1963 | United Kingdom . | |
| 967624 | 8/1964 | United Kingdom . | |
| 1053670 | 1/1967 | United Kingdom . | |
| 1121188 | 7/1968 | United Kingdom . | |

OTHER PUBLICATIONS

Research Disclosure #37038 published Feb. 1995, pp. 79–115.

Polymers at Interfaces, by Fleer, Stuart, Scheutjens, Cosgrove and Vincent, pp. 419–434.

Polymeric Stabilization of Colloidal Dispersions by Napper, pp. 332–413.

"Depletion Interaction and Phase Separation in Mixtures of Colloidal Particles and Nonionic Micelles" Progr. Colloid Polym Sci (1966) 100:201–205.

"The Effect of Triton X–100 on the Stability of Polystyrene Latices" Colloids and Surfaces, 28(1987) 1–7.

*Primary Examiner*—Mark F. Huff

*Attorney, Agent, or Firm*—Arthur H. Rosentein

[57] ABSTRACT

A method is disclosed for washing silver halide photographic emulsions, including desalting and/or concentrating, based on depletion phase separation mechanism, wherein phase separation is effected by the addition of water-soluble non-interactive and non-adsorbing non-ionic polymers or non-ionic surfactant micelles. The process involves the separation of the supernatant fluid, containing the undesirable water-soluble salts and the added phase separating agents, from the washed and condensed silver halide phase and redispersion of the latter.

13 Claims, No Drawings

WATER-SOLUBLE NON-INTERACTIVE POLYMERS AND SURFACTANT MICELLES FOR DESALTING AND CONCENTRATING SILVER HALIDE PHOTOGRAPHIC EMULSIONS

FIELD OF THE INVENTION

The present invention relates to the method of preparing silver halide photographic emulsions utilizing water-soluble non-interactive and non-adsorbing non-ionic polymers or non-ionic surfactant micelles as desalting agents for the removal of undesired dissolved salts and/or further concentration of the emulsions at the ambient pH of the prepared emulsions.

BACKGROUND OF THE INVENTION

Silver halide photographic emulsions are usually prepared by reacting an aqueous solution of halide salt with silver salt in the presence of a protective colloid, e.g. gelatin, to produce silver halide nuclei. After physical ripening to the desired grain size and size distribution, the emulsions are subjected to chemical and spectral sensitization. Generally, in the process of manufacturing a photographic silver halide emulsion, the silver halide emulsion is usually subjected to desalting to remove water-soluble salts such as excessive silver halides, alkali nitrate and ammonium salts after completion of physical ripening. Prior to or during the chemical and spectral sensitization, the resulting water-soluble salts, e.g. sodium nitrate and excess halide during the preparation of silver halide emulsion, should be removed to prevent deleterious effects on final coating applications. It is also desirable to concentrate the washed emulsions for subsequent addition of other photographically active components.

The desalting methods include a noodle method, a dialysis method, and a flocculation precipitation method. Of these methods, the flocculation precipitation method is extensively put into practical use.

The earliest method of removing the extraneous salts is by noodle washing (U.S. Pat. Nos. 2,527,260 and 3,396,027), wherein the prepared emulsion is chilled set and broken into small fragments and subjected to a continuous water flow to remove the salt by osmosis. This technique requires a large volume of water and is very time consuming, resulting in extensive swelling of the gelatin and dilution of the remelted emulsion.

Another washing method employs the precipitation of silver halide particles by the addition of large amounts of inorganic salts, e.g. sodium or magnesium sulfates, etc. (U.S. Pat. No. 2,618,556). The interface separating the supernatant fluid and the sediment silver halide particle in such case is not well-defined, resulting in difficulty for the removal of the supernatant fluid and the loss of silver halide grains. Small molecule organic salts, e.g. sulfonated benzene, naphthalene, or their condensates with formalin, or alkyl sulfates (U.S. Pat. No. 10 2,527,260; GB Patent Nos. 967,624; 945,334; 1,053,670), were also employed as coagulating agents. The formation of insoluble complex between the negative charge of the coagulant and the positive amino groups of gelatin at a pH lower than the isoelectric point of gelatin, results in phase separation and coagulation of the solid silver halide particles.

Anionic polymers were also used as coagulants to generate phase separation similar to those described above by small molecule coagulants. These polymers include sulfated poly(vinyl alcohol) (U.S. Pat. No. 3,867,154); poly(vinyl sulfonate) (GB Patent No. 967,624); poly(styrene sulfonate) or its copolymers (U.S. Pat. No. 3,168,403); other sulfonated polymers (U.S. Pat. Nos. 3,241,969; 3,137,576); the copolymers of carboxylate-containing monomers, such as acrylate, methacrylates, and maleic acids (U.S. Pat. Nos. 2,565,418; 4,087,282; 4,990,439; 5,411,849; 5,486,451; Japanese 62/32445; European Patent No. 88120367.3; GB Patent No. 1,121,188). By lowering the pH of the emulsions below the isoelectric point of gelatin, complexes between the polymers and gelatin, as well as the gelatin-coated silver halide particles, are formed and separated from the clear supernatant which contains most of the soluble salts. Similar to the above anionic polymers are the modified gelatin derivatives, e.g. the covalent reaction products of gelatin with carboxylic or sulfonic acid chlorides, carboxylic anhydrides, etc. (U.S. Pat. Nos. 2,614,928; 2,614,929; 2,614,931; 3,359,110; 3,867,154; 5,411,849). The insolubility of these modified gelatin coagulants at a pH below the isoelectric point of gelatin causes precipitation of silver halide particles, and hence the soluble salt in the supernatant can be removed by decanting or centrifugation. In all the aforementioned precipitation methods, pH lowering is necessary to bring about flocculation. The extraneous ionic coagulants remain in the silver halide bottom phase, resulting in difficulty in redispersing and increase in viscosity of the subsequently redispersed emulsion and also imparting adverse effects on the photographic performance of the silver halide emulsions such as fogging.

Two other physical separation methods for the removal of soluble salts are based on membrane techniques, e.g. ultrafiltration and electrodialysis (U.S. Pat. No. 5,523,201) by use of semipermeable membranes and ion exchange membranes, respectively. Membrane fouling and the lengthy time required for desalting and difficulty in further concentration of the emulsion are possible drawbacks of these processes.

Depletion phase separation in polymer latices containing non-adsorbing polymers have been studied extensively. Several theories have been proposed to explain such phenomena. (For general references, see "Polymers at Interfaces" by G. J. Fleer, M. A. Cohen Stuart, J. M. H. M. Scheutjens, T. Cosgrove, and B. Vincent, Chapman & Hall, 1993; "Polymeric Stabilization of Colloidal Dispersion" by D.H. Napper, Academic Press, 1983). Similar behavior is also observed with non-ionic surfactant micelles (e.g. see Progr. Colloid Polym Sci., 100, 201 (1996); Colloids and Surfaces, vol. 28, 1(1987)). The depletion phase separation is known in synthetic lattices to cause particle instability.

No working process has been described that will allow complete washing of photographic emulsion without the need for a pH adjustment which adds to the process and results in fogging.

SUMMARY OF THE INVENTION

The object of this invention is to provide a method of preparing light-sensitive silver halide emulsions, including all grain sizes and morphologies, by using as desalting agents, i.e., non-interactive, non-ionic polymers or non-ionic surfactant micelles, to remove the excess salts and water-soluble by-products without any pH adjustment. The phase separation is operated by a depletion phase separation mechanism, wherein most of the desalting agents added are excluded from the bottom silver halide phase and remain in the clear supernatant liquids containing the extraneous unwanted salts for subsequent removal. Another objective of this invention is to provide a method of concentrating the washed and redispersed emulsions for subsequent chemical and spectral sensitization. The redispersed emulsions thus obtained are devoid of the excess salts and the phase separating agents used.

In the present silver halide emulsions, the added polymers or surfactant micelles are soluble in aqueous salt solution containing gelatin and should not form complexes with gelatin, nor interact with the surface-coated gelatin to bring about "bridging" and flocculation of the particles. The added polymers or micelles are excluded from the sedimented silver halide phase and remain in the salt-containing supernatant liquids for subsequent removal. More importantly, the depletion phase separation is effected at the ambient pH of the prepared emulsion without any pH adjustment. In particular, the separated silver halide phase forms a gel-like network structure even at 40° C. This gel-like bottom phase is easy to be separated from the supernatant liquids and can be subjected to further washing with water without the loss of silver halide grains. In all cases, the volume of the bottom silver halide phase is much smaller than that of the supernatant liquid so that the concentration of the washed emulsion can be adjusted with further addition of aqueous gelatin solution. The redispersed emulsion is devoid of the phase separation agents used so that any possible deleterious effects on the photosensitive silver halide emulsions can be minimized.

DETAILED DESCRIPTION OF THE INVENTION

With the commonly used ionic coagulating agents, e.g. the sulfated, sulfonated, or carboxylated small molecules or polymers, or the modified gelatin, the coagulants added remain with the silver halide particles in the precipitated phase. Furthermore, pH lowering below the isoelectric point of gelatin (i.e., pH<5) is generally required to bring about coagulation. The coagulated phase is usually difficult to handle because of the higher viscosity of the precipitated phase caused by complex formation between the anionic sites of the coagulants and the positive amino groups on gelatin. The most severe problem is the loss of speed (photoactivity) frequently associated with the presence of ionic polymer when its amount exceeds 10 g of ionic moiety/mole of silver.

In the present invention, non-interactive and non-adsorbing, non-ionic polymers or non-ionic surfactant micelles are used as the flocculating agents to cause depletion phase separation. The polymers or micelles have minimum or no interaction with gelatin or gelatin-coated silver halide grains and are excluded from the particle phase once a certain critical concentration of the added flocculant is reached. This critical concentration for phase separation may be related to the molecular weights or coil dimensions of the polymers or the diameters of the surfactant micelles. Because phase separation is a result of osmotic pressure imposed by the dissolved polymer upon the particles causing the latter to aggregate, no pH adjustment is necessary for such separation. Since the polymers or the micelles do not adsorb onto the surface of the particles, a minimum amount of the extraneous phase separation agent is retained in the sedimented silver halide particle phase, and thus any adverse effects on the photographic performance of the light-sensitive silver halide grains can be reduced.

By non-ionic polymers or micelles, it is meant that the conductivity of a 10–20% solution must be equal or less than 50 $\mu$S/cm. This is critical to the present invention in that polymers or micelles having greater conductivity and ionic character would not be useful as this would require pH adjustment for flocculation.

The sedimented silver halide particle phase has a gel-like network structure even at 40° C., hence the loss of silver can be minimized during separation of the supernatant liquid from the silver halide phase by decanting or by low speed centrifugation. The integral gel-like characteristics of the silver halide phase also render further washing with water for the removal of any physically entrapped polymer or residual salts relatively easy. The volume of the sedimented silver halide phase is generally about 20 times less than that of the supernatant liquid so that the concentration of the final redispersed emulsion can be achieved to any desired level.

Any silver halide emulsion with a range of grain size from 0.1 micron to several microns may be subjected to the present washing procedure. The concentration of the silver halide particle in the initially prepared emulsion suitable for the present washing procedure may range from 0.5% to 20%, preferably from 5% to 10%. Further washing, if desired, may be conducted with de-ionized water. In addition, the washing procedure using the present non-interactive polymers or surfactant micelles may be applied to all types, and morphologies of silver halide emulsions, including iodide, chloride, bromide, bromoiodide, chlorobromide, etc.

There are many polymers which can be chosen as the phase separation agents in the present invention, as long as they are non-ionic and non-interactive in the presence of gelatin or gelatin-coated silver halide particles. Since the agents added are mostly excluded from the silver halide phase, the adverse effects on the photographic performance of the final washed emulsions frequently encountered by the use of conventional ionic coagulants can be greatly reduced. On the contrary, the residual amount of the non-interactive polymers which are physically entrapped in the washed emulsion may impart advantageous features to the final coated film, such as stabilization ability, plasticization, and enhanced physical resistance to abrasion. Similarly, the residual amount of surfactant micelles when used as the phase separation agent may act as a coating aid for subsequent coating applications.

The non-interactive and non-adsorbing polymers used in the present invention may include any commercially available synthetic or natural occurring water-soluble nonionic polymers as long as they do not react with gelatin or gelatin-coated silver halide particles in the normal pH range for emulsion preparation which is above 5.0 (pH=5.3–5.6). It is understood in the art that the term "non-interactive" means that the material has no chemical interaction with and is not physically adsorbed on or does not physically adsorb other materials in the composition. They may include all polymers composed of non-ionic hydrophilic monomers which can be synthesized by any prior art in polymer synthesis, such as free radical or ionic polymerization or polycondensation, or step-growth polymerization. Any micelle-forming polymers which are soluble in water and non-interactive in gelatin or in gelatin-coated silver halide particle solution also may be used.

In a preferred embodiment, the physicochemical nature of the non-ionic polymer and non-ionic surfactant micelles, suitable as the phase separation agent in the present invention, can be characterized by the following measurable parameters.

1) The conductivities of the aqueous stock solutions of non-ionic polymers or micelle surfactants (generally 5%–40% (w/w)) are relatively low. It is necessary they are equal or less than 50 $\mu$S/cm;

2) The concentration of the polymer stock solution may range from 5% to 50% (w/w), preferably from 5% to 30% (w/w), depending on the molecular weight and polymer coil dimensions. The viscosity of the stock solution may range from 10 cp to 10,000 cp, preferably from 100 cp to 1,500 cp;

3) The molecular weight of the water-soluble polymer preferably ranges from 300 to $1\times10^7$, preferably from $1\times10^3$to $1\times10^6$, more preferably from $10^4$ to $5\times10^5$. The radius of gyration of the polymer or the radius of the surfactant micelle may range from 1.5 nm to 200 nm, preferably from 3 nm to 100 nm;

4) The critical concentration of polymer required for phase separation to occur in a silver halide emulsion may preferably range from 0. 1% to 20%, preferably 0.5 to 15%, depending on the molecular weight and radius of gyration of the polymer, more preferably from 1% to 4%, i.e. 0.5 to 2.0 times the concentration of gelatin in the pre-washed emulsions. In the case of surfactants, this concentration is above the critical micelle concentrations;

5) The polymer or surfactant micelle is non-interactive in the presence of free gelatin in aqueous salt solution, such that the viscosity of the mixed solution containing the polymer and gelatin is not higher than the weight average of the viscosities of the polymer and gelatin (if it interacts with gelatin, it forms an insoluble complex and brings down silver halide with it);

6) The polymer or surfactant micelle is non-interactive in the presence of free gelatin in aqueous salt solution, such that the specific optical activity of the gelatin solution is unaltered by the addition of the polymer or surfactant micelle;

7) The polymer is non-interactive in the presence of free gelatin in aqueous salt solution, such that the light scattering intensity of the mixture is not greater than the weight average of the scattering intensities of the individual components; and 8) The polymer or surfactant micelle is non-adsorbing and repulsive to the surface of the gelatin-coated silver halide particle surface, such that the adsorption of the polymer or micelle on the particle cannot be detected by conventional analytical techniques, e.g., by aqueous size exclusion chromatography for measuring the adsorbed amount by UV or RI (refractive index) detectors, or by photon correlation spectroscopy (i.e., dynamic light scattering or quasi-elastic light scattering) for measuring the particle size increase upon addition of polymer or micelle.

Examples of the water-soluble, aqueous salt solution-soluble, and gelatin-soluble, non-interactive and non-adsorbing polymers which display the above characteristics may include non-ionic polymers, such as:

poly(ethylene glycol), or poly(oxyethylene), or poly (ethylene oxide) (e.g., PEG-20M, Union Carbide) (1)

poly(2-alkyl-oxazoline)(PEOX, Aldrich) (2)

poly(N-vinyl morpholine) (3)

poly(N-vinyl pyrrolidone)(PVP, BASF) (4)

poly(N-acryloyoxyethyl pyrrolidone) (5)

poly(N-vinyl piperidone) (6)

poly(acrylamide)(PA, Cyanamer from Cytex) (7)

poly(N-ethylacrylamide) (8)

poly(methacrylamide) (9)

poly(N-methylacrylamide) (10)

poly(N,N'-dimethylacrylamide)(X-100 (11)

poly(N-isopropylacrylamide) (12)

poly(2-hydroxyethylacrylamide) (13)

poly(2,2',2"-trihydoxyethylacrylamide) (14)

poly(2-hydroyethylacrylate)(PHEA) (15)

poly(N-acryloylmorpholine) (16)

poly(N-methyacryloylmorpholine) (17)

poly(N-acryloylpiperidine) (18)

poly(vinyl alcohol)(PVA, Air Products) (19)

poly(vinyl methyl ether)(PVME) (20)

polyphosphazenes, such as poly[bis(methoxyethoxy) phosphazene) (MEEP) (21)

dextran (Pharmachem Corp) (22)

polysucrose or water-soluble starch (23)

Ficoll (24)

water-soluble agarose and starch (25)

cyclodextrins; and (26)

hydroxyethyl cellulose (HEC, Union Carbide), or other water soluble cellulose (27)

Furthermore, water-soluble copolymers consisting of any combination of the monomers mentioned in the above homopolymers or with other vinyl comonomers containing heterocyclics, such as N-vinyl oxazolidone and N-vinyl lactams are also included for this application.

Micelle-forming block or graft amphiphilic copolymers consist of non-ionic monomer blocks and hydrophobic monomer blocks may be used. These include the Pluronic and Tetronic block copolymers (BASF), (31) or the graft copolymer type, such as Dapral GE-202 (Akzo Chemie America). (32)

Examples of the non-ionic surfactant, which forms micelles above its critical micelle concentration, may include the commercially available surfactants, such as, alkylphenol polyoxyethylene ethers (Triton series) (33)

polyoxyethylene ethers (Brij series) (34)

polyoxytheylene esters (Myrj series) (35)

polyoxyethylene sorbitan esters (Tween series) (36)

polyoxyethylene substituted sugar (Glucamate series by Amerchol)(37)

and other sugar surfactants, such as β-D-alkylglucosides (38).

Preferably, the concentration of these surfactants for phase separation may range from 3% to 10%. The radius of the micelles suitable for phase separation in the present silver halide emulsions preferably ranges from 2 nm to 10 nm.

EXAMPLES

Examples of the present invention are described in detail below. This invention is not limited to the specific types, sizes, and morphologies of the silver halide grains. The use of other polymers or surfactant micelles which are shown to be non-ionic and non-interactive in gelatin or non-adsorbing on the gelatin-coated silver halide grains, as described in the aforementioned characteristics, are also useful. Three types of silver halide emulsions were prepared as described in the following examples and used to demonstrate the application of the present invention employing various phase separating agents.

Example 1

(Cubic Silver Chloro-bromide Emulsion)

Emulsion EM01—A silver halide cubic emulsion, containing 70 mol % chloride and 30 mol % bromide ions, was prepared by the conventional double-jet precipitation procedures (see "Typical and preferred color paper, color negative, and color reversal photographic elements and processing", Research Disclosure, Item 37038, February 1995, disclosed anonymously). The emulsion grains were found to be monodisperse with an average size of 0.15 μm. At the end of the double-jet precipitation, the emulsion was deionized and concentrated by the standard ultrafiltration procedure. The emulsion was subsequently treated with chemical and spectral sensitization by standard procedures commonly used in the industry. This emulsion is referred to as EM01.

Emulsion EM02—Another emulsion was precipitated by the same method used for EM01. The pre-washed emulsion at the end of the double-jet precipitation (10 moles of silver halide) was referred to as EM02. This emulsion was divided into several portions (575 g each containing 0.345 moles of silver halide) in stainless steel beakers each containing a magnetic stirring device and thermostated in a 40° C. water bath. Each portion of the emulsion was subjected to the washing process using various polymers as listed in Table 1a.

The procedure for desalting, concentrating, and redispersing of EM02 emulsion can be exemplified as follows, including data for conductivity and polymer distribution in the supernatant liquid and the sediment phase:

1a) Desalting with poly(2-ethyl-oxazoline)—To the 575 g (=0.345 mol silver) EM02 emulsion was added 75 g of an aqueous stock solution of poly(2-ethyl-oxazoline) (Mw=398,000, 20% with pH adjusted to the same value as that of the emulsion, i.e. pH=5.3) with constant stirring at 40° C. for 10 minutes. Phase separation was observed after the mixture was allowed to stand at 40° C. for 10–20 minutes. The supernatant was decanted, and the silver halide bottom phase, without further washing, was redispersed with a known amount of gelatin solution so that the final gelatin concentration of the washed emulsion is about 30 g gelatin/mol silver. This redispersed emulsion was subjected to the same chemical and spectral sensitization by the standard procedure known in the art as used for EM01 and stored for later photographic coating and evaluation. Discussion of the photographic results and comparison among the emulsions washed by other polymers is found later in conjunction with the data presented in Tables 1a–1b.

To another 57.5 g of EM02 emulsion was added 10 g of a poly(2-ethyl-oxazoline) stock solution (Mw=200,000, 20%), and the solution was incubated at 40° C. and allowed to settle overnight. The supernatant was decanted and the conductivity was measured to be 58.5 mS/cm, compared with the initial value of 49.0 mS/cm for the mixture before phase separation. The silver halide bottom phase containing 0.034 mol silver was redispersed with gelatin (1 g) and water so that the final gelatin concentration is ~30 g/mol silver. The conductivity was measured to be 6.6 mS/cm. In contrast, for the use of ionic polymer as coagulant, the conductivity of the redispersed bottom phase is ~25 mS/cm. Also similar results were found for the use of modified gelatin. Normally, two washes were required to remove the salt. In addition, it is more difficult to redisperse the emulsion grains by using ionic polymers.

To another 28.75 g of EM02 emulsion was added 5 g of the same poly(2-ethyl-oxazoline) stock solution (Mw=200,000, 20%). The mixture was allowed to phase separate in 10 minutes, and then subjected to a low speed centrifugation (1000 g) for 10 minutes. The supernatant was collected for silver analysis by neutron activation and for polymer concentration analysis by aqueous size exclusion chromatography. Neutron activation analysis of the supernatant indicates that the amount of silver is below the detection limit of 40 μg/mL. For the polymer analysis by liquid chromatography, digestion of gelatin which is also present in the supernatant is necessary because the elution curves for the polymer and gelatin overlap each other. One gram of the supernatant was added with a proper amount of an enzyme. The enzyme used is PR-1000 produced by Genencor International, Inc. It is a bacterial alkaline protease produced by the fermentation of *Bacillus licheniformis*. PR-1000 is made in a solution containing 800 proteolytic activity (PAU) unites/mL. For complete gelatin degradation in the supernatant sample containing ~1.7% gelatin, each gram of gelatin requires 0.03 gram of the PR-1000 solution. The supernatant solution was adjusted to pH=9 and incubated at 40° C. for one hour before injection for chromatographic analysis. The bottom silver halide phase was also treated with a proper amount of enzyme and a known amount of water. The supernatant of this mixture after being subjected to centrifugation at 14,000 g for 20 minute was also analyzed for polymer content. The final result indicate that more than 99% of the polymer added for the phase separation is retained in the supernatant fluid and less than 0.5–1.0%, (i.e.<1 g/mol silver), of the polymer is entrapped in the bottom silver halide phase. This amount can be reduced if the bottom silver halide phase is further dehydrated with higher g-force or washed with water.

1b) Desalting with dextran—To the 575 g (=0.345 mol silver) EM02 emulsion was added 100 g of an aqueous stock solution of dextran (Mw=460,000, 20% with pH adjusted to the same value as that of the emulsion, i.e. pH=5.3). The procedure for phase separation, decanting, and redispersing the emulsion, was the same as that used in Example (1a). The time required for complete phase separation is approximately 20–25 minutes, slightly longer than that by using poly(2-ethyl-oxazoline) as the flocculant. Comparison of photographic results are made later along with other polymers listed in Tables 1a–1b.

To another 57.5 g of EM02 emulsion was added 10 g of dextran stock solution (Mw=460,000, 20%), and the solution was incubated at 40° C. and allowed to settle overnight. The supernatant was decanted and the conductivity was measured to be 61.4 mS/cm, compared with the initial value of 51.0 mS/cm for the mixture before the onset of phase separation. The silver halide bottom phase containing 0.034 mol silver was redispersed so that the final gelatin concentration is ~30 g/mol silver. The conductivity was measured to be 9.7 mS/cm.

To another 28.75 g of EM02 emulsion was added 5 g of the same dextran stock solution (Mw=460,000, 20%). The mixture was allowed to phase separate in 20 minutes, and then subjected to a low speed centrifugation (1500 g) for 25 minutes. The supernatant was collected for silver analysis by neutron activation and for dextran concentration analysis by aqueous size exclusion chromatography, using the same procedure as described in Example (1a). No detectable silver in the supernatant was observed by neutron activation. The chromatographic result indicates that there was <1 g dextran/mol silver retained in the bottom phase. This amount can be further reduced if the bottom silver halide phase is dehydrated with higher g-force or washed with water.

Summarized in Table 1a are the formulations for phase separation using various polymers and surfactants as the desalting agents for the small cubical EM02 emulsion, each formulation requires 575 g of the pre-washed emulsion at the ambient pH of 5.3. The molecular-weight dependence of the phase separation concentration for a given polymer, e.g. PEO, PEOX, Dextran, as shown in the Table, is consistent with the depletion phase separation mechanism operative in many latex systems with non-adsorbing polymers as the phase separation agents. Contrary to the present results, an interactive ionic polymer such as sodium poly(styrene sulfonate) does not produce phase separation under the same formulation condition. The molecular weights tested for each polymer or surfactant are listed under column 2. The weights of each polymer with specified stock concentration are shown under column 3. The last column lists the critical polymer concentration required for phase separation (Cps) of an emulsion sample (575 g).

Table 1b shows the results of various photographic performance for the EM02 emulsion treated with some of the polymers as the desalting and concentrating agents. The emulsion EM02 was subsequently treated with chemical and spectral sensitization by the same procedures used for EM01. Included for comparison are the results for the ultra-filtration check EM01 emulsion. As evident from these data, the polymer-washed EM02 emulsions yielded excellent photographic performance in comparison with the check EMO01 sample.

TABLE 1a

Formulations for Phase Separation with 575 g of EM02 Emulsion (40° C.)

| Polymer | MW | g of Polymer Stock (%) | Polymer Concentration (%) for Phase Separation (Cps) |
|---|---|---|---|
| PEG-20M | $2 \times 10^4$ | 100 (30%) | 5.0 |
| PEG | $8 \times 10^3$ | 100 (40%) | 6.7 |
| PEG | $5 \times 10^3$ | 150 (40%) | 9.2 |
| PEG | $2 \times 10^3$ | 300 (40%) | 15.0 |
| PEG | $1 \times 10^3$ | 500 (40%) | 20.0 |
| PEG | 750 | 500 (40%) | 20.0 |
| PEG | 350 | 500 (40%) | 20.0 |
| PEOX | $4 \times 10^5$ | 75 (20%) | 2.67 |
| PEOX | $2 \times 10^5$ | 100 (20%) | 3.33 |
| Dextran | $4.6 \times 10^5$ | 110 (20%) | 3.61 |
| Dextran | $1.8 \times 10^4$ | 300 (40%) | 15.0 |
| Dextran | $9 \times 10^3$ | 500 (40%) | 20.0 |
| PA | $1 \times 10^4$ | 100 (28%) | 4.67 |
| X-100 | $2.4 \times 10^5$ | 100 (10%) | 1.67 |
| HEC | $1 \times 10^5$ | 125 (10%) | 2.00 |
| Vinol3SO | $1.4 \times 10^5$ | 100 (10%) | 1.67 |
| PVP | $3.7 \times 10^5$ | 100 (20%) | 3.33 |
| Starch | — | 87.5 (20%) | 3.00 |
| Plurornc F-68 | $8.4 \times 10^3$ | 125 (30%) | 6.0 |
| Pluronic F-108 | $1.46 \times 10^4$ | 150 (20%) | 4.62 |
| Tetronic 908 | $2.5 \times 10^4$ | 85 (30%) | 4.36 |
| Tetronic 1508 | $3.0 \times 10^4$ | 150 (20%) | 4.62 |
| Dapral GE-202 | $2.0 \times 10^4$ | 125 (30%) | 11.25 |

| Surfactant | g of Surfactant Stock (%) | Surfactant Concentration (%) for Phase Separation |
|---|---|---|
| Triton X-100 | 200 (20%) | 5.71 |
| Triton X-705 | 150 (40%) | 9.23 |
| Triton X-405 | 75 (70%) | 9.13 |
| Tyloxapol | 150 (33.3%) | 7.68 |
| Tween 80 | 187.5 (40%) | 10.91 |
| Myrj 59 | 150 (13.3%) | 3.07 |
| Myrj 52 | 250 (13.3%) | 4.43 |
| Brij 700 | 150 (13.3%) | 3.07 |
| Brij 35 | 200 (28.6%) | 8.17 |
| Glucamate (DOE-120) | 200 (20%) | 5.71 |

TABLE 1b

Photographic Results for the Polymer-Washed EM02 Emulsions

| Polymer | Fog | Silver Density | Speed | Contrast | Grain Size ($\mu$m) |
|---|---|---|---|---|---|
| PEO | 0.06 | 3.36 | 133 | 1.96 | 0.15 |
| PEOX | 0.074 | 3.4 | 127 | 1.86 | 0.15 |
| PA | 0.04 | 3.51 | 141 | 2.03 | 0.15 |
| X-100 | 0.05 | 3.3 | 132 | 2.04 | 0.15 |
| Dextran | 0.05 | 3.23 | 129 | 2.0 | 0.15 |
| HEC | 0.06 | 3.3 | 129 | 2.0 | 0.15 |
| Vinol 350 | 0.06 | 3.24 | 124 | 1.85 | 0.15 |
| UF(EM01) | 0.05 | 3.35 | 125 | 1.84 | 0.15 |

Example 2

(Cubic Silver Chloride Emulsion)

Emulsion EM03—A silver chloride cubic emulsion was prepared by the conventional double-jet precipitation procedures similar to that of emulsion EM02. The emulsion grains were found to be monodisperse with an average size of 0.75 $\mu$m. This pre-washed emulsion is refereed to as EM03. The formulations for the desalting process using various polymers are listed in Table 2.

TABLE 2

Formulations for Phase Separation with 575 g of EM03 Emulsion (40° C.)

| Polymer | MW | g of Polymer Stock (%) | Polymer Concentration (%) for Phase Separation (Cps) |
|---|---|---|---|
| PEG 20M | $2 \times 10^4$ | 87.5 (30%) | 4.47 |
| PEOX | $2 \times 10^5$ | 75 (20%) | 2.60 |
| X-100 | $2.4 \times 10^5$ | 75 (10%) | 1.30 |
| Dextran | $4.6 \times 10^5$ | 100 (20%) | 3.33 |
| REC | $1 \times 10^5$ | 100 (10%) | 1.67 |
| Vinol 350 | $1.4 \times 10^5$ | 85 (10%) | 1.45 |
| PVP | $3.7 \times 10^5$ | 125 (10%) | 4.00 |

Example 3

(Tabular Silver Bromo-iodide Emulsion)

Emulsion EM04—A silver bromo-iodide emulsion of tabular morphology was prepared by the conventional double-jet precipitation (see U.S. Pat. No. 5,476,760). The dimensions of the emulsions grain are 2.3 $\mu$m×0.12 $\mu$m. The formulations for the desalting process using various polymers are listed in Table 3.

TABLE 3

Formulations for Phase Separation with 575 g of EM04 Emulsion (40° C.)

| Polymer | MW | g of Polymer Stock (%) | Polymer Concentration (%) for Phase Separation (Cps) |
|---|---|---|---|
| PEG-20M | $2 \cdot 10^4$ | 137.5 (30%) | 6.47 |
| PEOX | $2 \times 10^5$ | 85 (20%) | 2.90 |
| X-100 | $2.4 \times 10^5$ | 75 (10%) | 1.30 |
| Dextran | $4.6 \times 10^5$ | 75 (20%) | 2.61 |
| HEC | $1 \times 10^5$ | 75 (10%) | 1.30 |
| Vinol350 | $1.4 \times 10^5$ | 75 (10%) | 1.30 |
| PVP | $3.7 \times 10^5$ | 100 (10%) | 3.33 |

The invention has been described in detail with particular reference to certain preferred embodiments thereof, but it will be understood that variations and modifications can be effected within the spirit and scope of the invention.

What is claimed is:

1. A method of washing and separating a silver halide emulsion said method comprising: using an aqueous stock solution of a member of the group consisting of a water-soluble polymer which is non-ionic and surfactant micelles and gelatin in a depletion phase separation process so that said polymer remains in a supernatant solution and does not coagulate with said gelatin and silver halide grains and no pH change is made in the phase separation process comprising:

a) adding at least one aqueous stock solution into the silver halide emulsion to induce said depletion phase separation, said solution containing gelatin and a member of the group consisting of a water-soluble polymer which is non-ionic and surfactant micelles characterized by the following parameters:

1) The conductivity's of the aqueous stock solution of non-ionic polymers or micelle surfactants are equal to or less than 50 $\mu$S/cm;

2) The concentration of the polymer or micelles in the aqueous stock solution ranges from 5% to 50% (w/w); the viscosity of the aqueous stock solution ranging from 10 cp to 10,000 cp;

3) The molecular weight of the polymer or micelles ranging from 300 to $1\times10^7$, the radius of gyration of the polymer or the surfactant micelle ranging from 1.5 mn to 200 nm;

4) said depletion phase separation carried out using a critical concentration of polymer in a silver halide emulsion ranging from 0.1% to 20%; (w/w) of polymer;

5) The polymer or surfactant micelle is non-interactive with gelatin in the presence of free gelatin, such that the viscosity of the aqueous stock solution containing the polymer or micelle and gelatin is not higher than the weight average of the viscosities of the polymer or michelle and gelatin;

6) The polymer or surfactant micelle is non-interactive, such that the specific optical activity of the aqueous stock solution is unaltered by the addition of the polymer or surfactant micelle;

7) The polymer is non-interactive with gelatin, such that the light scattering intensity of the aqueous stock solution is not greater than the weight average of the scattering intensities of the individual components; and 8) The polymer or surfactant micelle is non-adsorbing and repulsive to the emulsion such that the adsorption of the polymer or micelle cannot be detected by aqueous size exclusion chromatography for measuring the adsorbed amount by ultraviolet light or refractive index detectors, or by photon correlation spectroscopy for measuring particle size increase upon addition of polymer or micelle;

b) removing supernatant liquid containing salts and said polymer or micelle from a washed emulsion.

2. The method of claim 1 wherein the stock solution is 5%–40% (w/w) of said non-ionic polymer or micelle.

3. The method of claim 1 wherein the process includes desalting and/or concentrating.

4. The method of claim 1 wherein said emulsion is at a pH above 5.0, and no pH adjustment is required for phase separation upon addition of said polymer or surfactant micelle.

5. The method of claim 1 wherein the viscosity of the stock solution ranges from 100 cp to 1,500 cp.

6. The method of claim 5 wherein the polymer or micelle is in a concentration range from 5% to 30% (w/w) in said aqueous stock solution.

7. The method of claim 1 wherein said emulsion comprises silver halide grains selected from the group consisting of silver chloride, silver bromide, silver iodide, silver chloro-bromide and silver bromo-iodide.

8. The method of claim 1 wherein said emulsion is not limited by grain sizes and morphologies.

9. The method of claim 1 wherein the molecular weight is $1\times10^4$ to $5\times10^5$.

10. The method of claim 1 wherein depletion phase separation is carried out with the polymer or micelle in a silver halide emulsion having a concentration range from 1% to 20%.

11. The method of claim 10 wherein the concentration of said polymer or micelle is from 1% to 4%.

12. The method of claim 1 wherein the polymer is selected from the group consisting of poly(ethylene glycol), poly(oxyethylene), poly(ethylene oxide)
poly(2-alkyl-oxazoline)
poly(N-vinyl morpholine)
poly(N-vinyl pyrrolidone)
poly(N-acryloyoxyethyl pyrrolidone)
poly(N-vinyl piperidone)
poly(acrylamide)
poly(N-ethylacrylamide)
poly(methacrylamide)
poly(N-methylacrylamide)
poly(N,N'-dimethylacrylamide)
poly(N-isopropylacrylamide)
poly(2-hydroxyethylacrylamide)
poly(2,2',2"-trihydoxyethylacrylamide)
poly(2-hydroyethylacrylate)
poly(N-acryloylmorpholine)
poly(N-methyacryloylmorpholine)
poly(N-acryloylpiperidine)
poly(vinyl alcohol)
poly(vinyl methyl ether)
polyphosphazenes
dextran
water-soluble starch
polysucrose
water-soluble agarose and starch
cyclodextrins; and
hydroxyethyl cellulose.

13. The method of claim 1 wherein the micelle is selected from the group consisting of alkylphenol polyoxyethylene ethers
polyoxyethylene ethers
polyoxytheylene esters
polyoxyethylene sorbitan esters
polyoxyethylene substituted sugar.

* * * * *